United States Patent [19]

Gemvik

[11] 4,169,417

[45] Oct. 2, 1979

[54] SUPPORT FOOT DEVICE FOR LOAD CARRIERS

[76] Inventor: Åke O. V. Gemvik, Gökvägen 71, S-183 51 Täby, Sweden

[21] Appl. No.: 856,082

[22] Filed: Nov. 30, 1977

[30] Foreign Application Priority Data

Dec. 15, 1976 [SE] Sweden ..... 7614087

[51] Int. Cl.[2] ..... B65D 19/06; B65D 19/40

[52] U.S. Cl. ..... 108/56.3; 206/599; 248/346

[58] Field of Search ..... 108/56.3, 56.1, 51.1, 108/51.3, 52.1–53.3, 55.1–55.5, 57.1, 156, 157, 90; 206/599, 600, 595–598, 386; 248/188, 188.8, 346, 152, 174

[56] References Cited

U.S. PATENT DOCUMENTS

| | | | |
|---|---|---|---|
| 2,029,983 | 2/1936 | Burke | 206/599 X |
| 2,841,350 | 7/1958 | Chronister | 108/56.3 |
| 2,902,199 | 9/1959 | Breton | 108/55.1 X |
| 3,729,244 | 4/1973 | Butler | 108/157 X |
| 3,831,744 | 8/1974 | Walden et al. | 108/55.1 X |
| 3,976,013 | 8/1976 | Woodford | 108/56.3 |

*Primary Examiner*—Roy D. Frazier
*Assistant Examiner*—William E. Lyddane

[57] ABSTRACT

Support foot devices are provided to be secured under load carriers such as boxes and carton packages each device comprising an elongate carrier plate and at least two support feet spaced from each other and secured on the carrier plate, the side of the carrier plate opposite to the support feet having a flat, slablike connecting piece which is aligned with the carrier plate, the opposing ends of said connecting piece forming free insert flaps adapted to be inserted into insert pockets in or at the lower side of one or two of such load carriers.

13 Claims, 7 Drawing Figures

SUPPORT FOOT DEVICE FOR LOAD CARRIERS

BACKGROUND OF THE INVENTION

The present invention relates to a support foot device for load or goods carriers such as load containers in the form of boxes and carton packages, or slablike elements, said support foot device comprising an elongate carrier plate and at least two support feet spaced from each other and secured on the carrier plate.

The object of the invention is to provide novel and improved support foot devices which have a simple, easily handled and reliable construction, and which facilitate the handling of such load carriers as carton packages, boxes, slablike elements and other load supporting means thereby making them easily adaptable to most modern handling means such as fork trucks, thus replacing the conventional loading pallets.

SUMMARY OF THE INVENTION

The support foot device according to the invention fulfils this object it being characterised in that the surface of the carrier plate opposite to the support feet has a flat, slablike connecting piece which is aligned with the carrier plate, the opposing ends of said connecting piece forming free insert flaps adapted to be inserted into insert pockets in or at the bottom or lower side of one or two carriers in order to secure the support foot device thereto.

The invention will be more fully described in the following with reference to the drawings.

DESCRIPTION OF THE INVENTION

Figure 1:
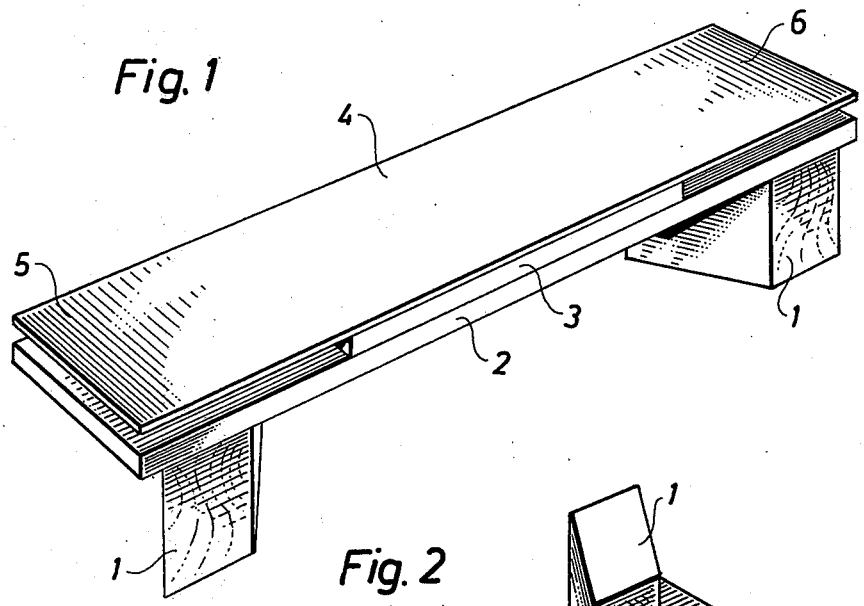
FIG. 1 shows a support foot device for load carriers according to the invention seen in a perspective view from above.
Figure 2:
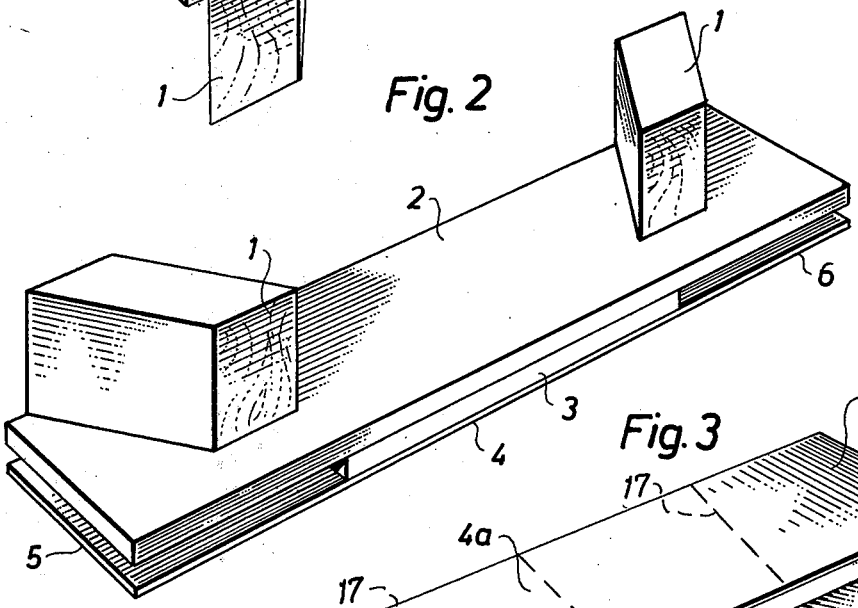
FIG. 2 shows the support foot device according to FIG. 1 turned up and down.

The support foot device shown in FIGS. 1 and 2 comprises two support feet 1 spaced from each other, in this case consisting of obliquely cut wooden blocks. The support feet 1 are secured to the lower side of an elongate carrier plate 2 in the form of a rectangular plank or the like provided at the centre thereof with a spacer or distance means 3 which in turn supports a flat, slablike connecting piece 4. The connecting piece 4 is aligned with the carrier plate 4 and its opposing ends form free inserts or insert flaps 5, 6, thus lying as far above the carrier plate 2 as the thickness of the shorter spacer means 3. The insert flaps are adapted to be brought into engagement with corresponding insert pockets provided in or at the bottom or lower side of a goods or load carrier. Since the spacer means 3 is shorter than the carrier plate 2 and the connecting piece 4, the insert flaps can easily be gripped and inserted into said insert pockets. The connecting piece is made of a rigid material, preferably inflexible, but the material may also be flexible depending on the arrangement of the insert pockets in or at the bottom of the load carrier. If the material is flexible it should also preferably be resilient. The connecting piece has preferably the same length as the carrier plate.

Figure 3:
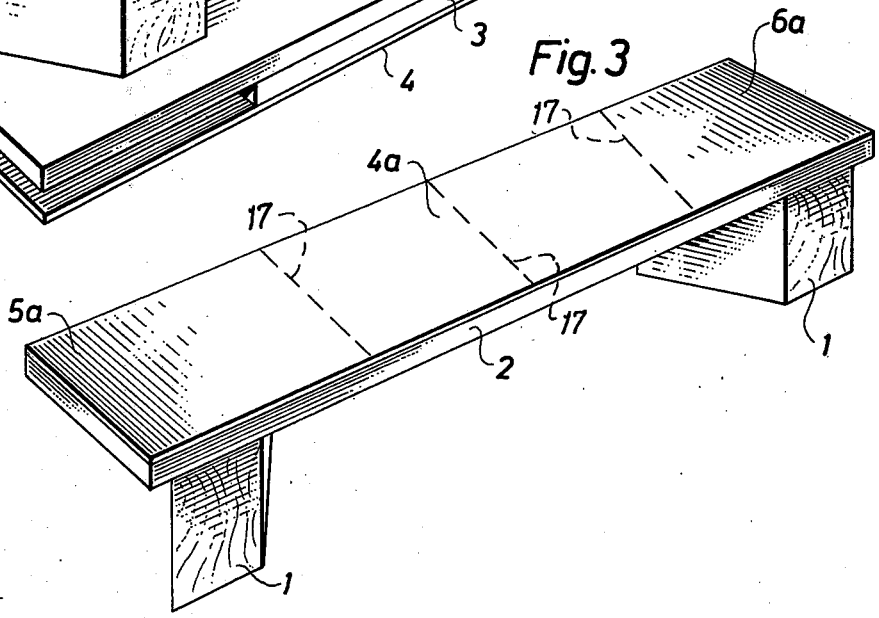
FIG. 3 shows a modification of the support foot device according to FIGS. 1 and 2.

The embodiment according to FIG. 3 is the same as that shown in FIGS. 1 and 2 except that the spacer means has been omitted, the connecting piece 4*a* being secured directly to the carrier plate 2 in a suitable manner such as by glueing or nailing within a limited central area generally identified by the dotted lines 17 and substantially corresponding to or smaller than the extent of the spacer means described above, for instance a single linear or transverse row of nails at the centre of the connecting piece. The connecting piece 4*a* thus secured at its centre or central section, thereby has two opposing inserts or insert flaps 5*a*, 6*a*, which are flexible so they can easily be gripped and raised sufficiently to permit the support foot device to be secured to the load carrier. In this case the connecting piece must necessarily consist of a firm but flexible material, preferably also resilient.

Figure 4:
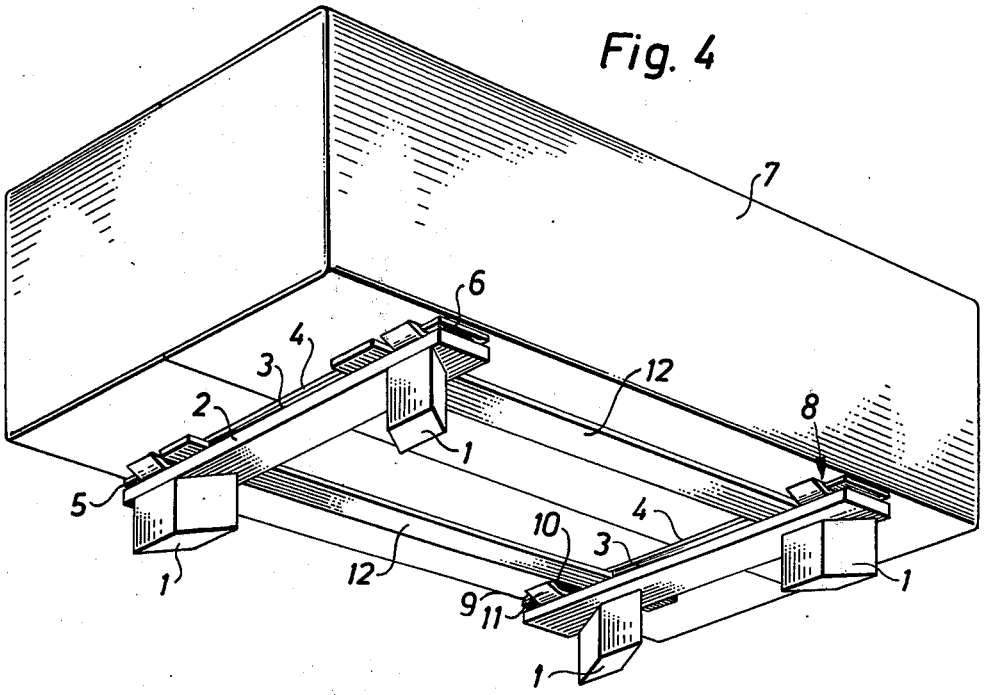
FIG. 4 shows a load carrier in the form of a box provided with support foot devices in accordance with the embodiment shown in FIGS. 1 and 2.

FIG. 4 illustrates the use of the support foot device in accordance with the embodiment shown in FIGS. 1 and 2. A goods or load carrier 7 in the form of a comparatively small box of for instance, cardboard or corrugated cardboard, is provided in advance, preferably at the time of manufacture, with two pairs of pockets 8 extending substantially perpendicular to the longitudinal direction of the support foot means or device. Each pocket 8 is formed of two short parallel cuts or slits 9, 10 arranged a short distance from each other, defining a bridge 11 therebetween which will enclose one of the insert flaps 5, 6, of the support foot device. According to an alternative, preferred embodiment, each pocket is formed by only one such slit so that the ends of the insert flaps are hidden after insertion therein. Two planks 12 or other suitable connecting elements are placed between the bottom of the box and the support foot device as shown in FIG. 4. These may be secured to the support foot devices so that a pallet-like unit is formed to be applied and secured under the box.

Figure 5:
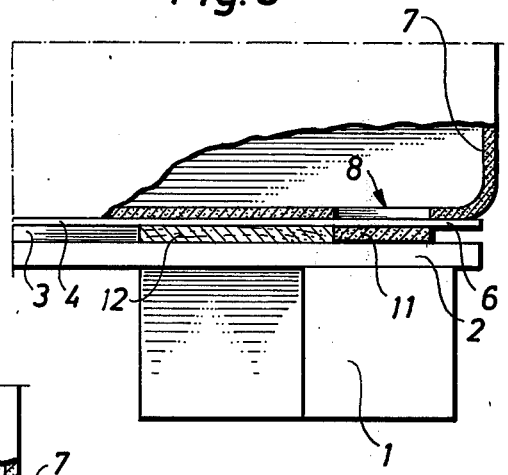
FIG. 5 shows parts of the arrangement according to FIG. 4.
Figure 6:
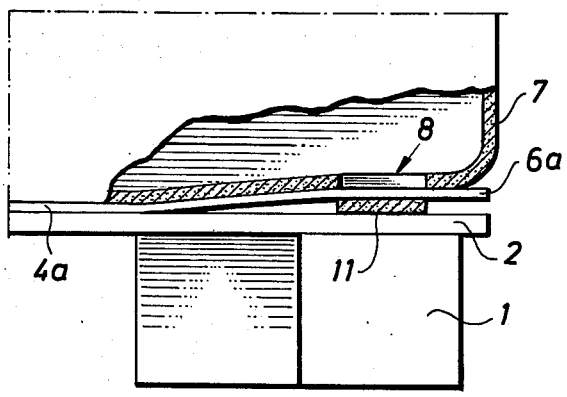
FIG. 6 shows parts of a similar arrangement but with a support foot device in accordance with the embodiment shown in FIG. 3.

FIG. 5 reveals parts of the arrangement according to FIG. 4 near one of the support feet 1 and FIG. 6 shows the corresponding part when a support foot device according to the embodiment shown in FIG. 3 is used, i.e. without any spacer means.

Figure 7:
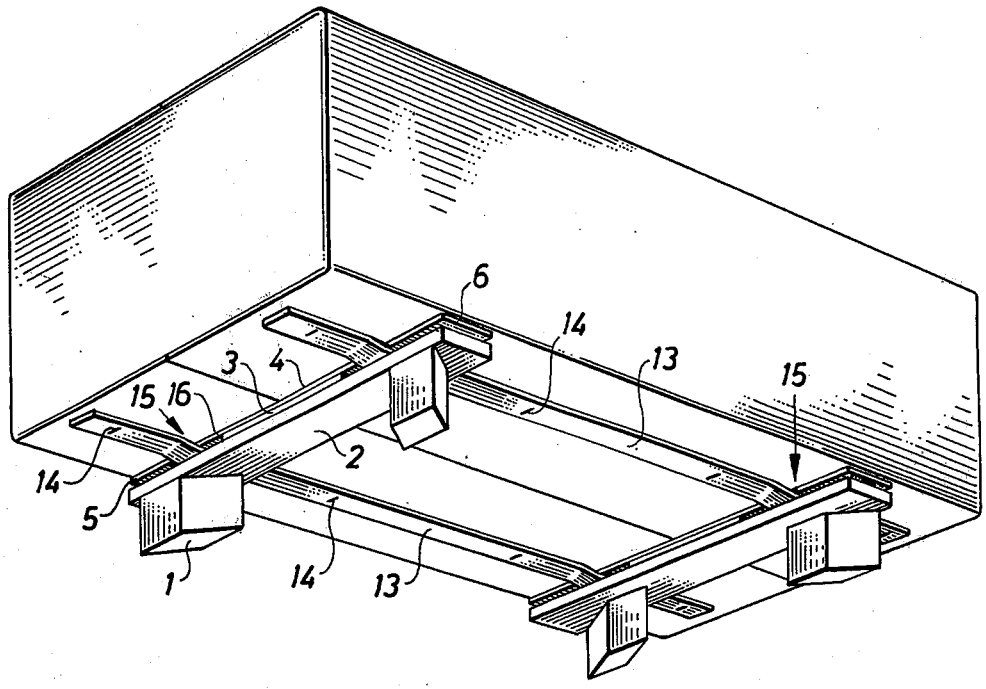
FIG. 7 shows a box provided with support foot devices in accordance with the embodiment shown in FIGS. 1 and 2, but secured in a manner different from that illustrated in FIG. 4.

FIG. 7 illustrates another way of using the support foot devices according to the present invention. Instead of making special slits in the bottom of the box, two parallel tapes or strips 13 are secured by attachment means 14 to the lower side of the box in the vicinity of the longitudinal edges of the box. The attachment means are arranged so that the tape 13 forms pockets 15 in the vicinity of the transverse edges of the box. The insert flaps 5, 6 of the support foot device can easily be inserted into these pockets 15 so that the support foot devices are secured to the box in the desired manner. If desired, the ends of the strips 13 may be passed through slits in the bottom of the box to be secured inside the box. Each strip may also be passed up and down through a number of slits (for instance four slits) arranged one after the other in the bottom of the box so that these pockets are formed. In this case attachment means are only required to secure the ends of the strips in the box or in or on another type of load carrier. Glueing may also be used to attach the strips.

The distance between the pockets in each pair should suitably be such that it is slightly greater than the distance from one end 16 of the spacer means (or corresponding attachment point if the spacer means is omitted) to the other end of the connecting piece 4. This facilitates insertion of the insert flaps into the pockets, especially when the connecting piece is relatively stiff.

The support feet may be of wood, plastic or metal, as may the carrier plate. The connecting piece may preferably consist of masonite or some other fibreboard material, plywood or wood, but even plastic and metal may be used.

The handling system described, which may be considered to constitute an additional aspect of the present invention, thus comprises prefabricated support foot devices and goods or load carriers adapted thereto, preferably boxes and carton packages of cardboard and corrugated paper preformed with insert pockets to receive the insert flaps of the support foot devices. According to a modification of this system, a support foot device is applied to the lower side of a box in such a way that one half of the bottom of the box is inserted in the space between the connecting piece and the carrier plate, after which one insert flap, now located inside the box, is passed out through a slit in this half of the bottom. In this case the support foot devices are considerably longer than the width of the box and another box is applied in a corresponding manner at the opposite end of the same support foot device. A second support foot device, equally long, is applied on these boxes spaced from each other in the same way, parallel with the first support foot device but at a suitable distance therefrom. The space between the two boxes is used to load additional boxes directly onto the support foot devices without engagement therewith.

What is claimed is:

1. In combination with a load carrier having pocket means positioned on the bottom surface thereof, a support device comprising an elongate carrier plate and at least two support feet, spaced from each other, and being securably mounted on the bottom side of said carrier plate, a connecting member corresponding in general configuration to said carrier plate, directly and securably fastened in its central region to the top side of said carrier plate in the central region thereof, the opposing ends of said connecting member being contiguous with but freely disposable from the opposing ends of said carrier plate, said connecting member being of resilient construction with the ends thereof being deflectable for insertion within the pocket means.

2. A load carrying assembly comprising in combination:

(a) Load carrying means having a plurality of spaced pocket means positioned on the bottom surface thereof, and (b) A supporting device being at least one support member comprising a carrier plate and at least two support feet, spaced from each other, and being securably mounted on the bottom side of said carrier plate, a connecting member corresponding in general configuration to said carrier plate and fastened to the top thereof, the opposing ends of said connecting member being adjacent to but freely disposed from the opposing ends of said carrier plate, and being inserted within said spaced pocket means.

3. A load carrying assembly according to claim 2 wherein said carrier plate is elongate.

4. A load carrying assembly according to claim 2 wherein said connecting member is securably fastened to said carrier plate in their respective central regions.

5. A load carrying assembly according to claim 4 wherein said connecting member and said carrier plate are securably fastened directly one to the other.

6. A load carrying assembly according to claim 2 wherein said connecting member and said carrier plate are securably fastened one to the other through a spacer means located at their respective central regions.

7. A load carrying assembly according to claim 2 wherein both said carrier plate and said connecting member are of rigid construction.

8. A load carrying assembly according to claim 2 wherein said connecting member is of resilient construction.

9. A load carrying assembly according to claim 2 wherein said supporting device comprises a pair of support members.

10. A load carrying assembly according to claim 2 wherein said pocket means comprises at least one pair of slits located on the bottom surface of said carrying means.

11. A load carrying assembly according to claim 2 wherein said pocket means comprises two pairs of pockets extending substantially perpendicular to the longitudinal direction of said supporting device.

12. A load carrying assembly according to claim 11 wherein each of said two pairs of pockets comprises two slits located on the bottom surface of the carrying means, forming insert means for receiving the opposing ends of said carrier member.

13. A load carrying assembly according to claim 2 wherein said pocket means comprises at least two parallel strips secured to the bottom surface of said load carrying means.

* * * * *